US007695107B2

(12) United States Patent
Shimizu

(10) Patent No.: US 7,695,107 B2
(45) Date of Patent: Apr. 13, 2010

(54) INK-JET PRINTER

(75) Inventor: Yoichiro Shimizu, Kasugai (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 335 days.

(21) Appl. No.: 11/177,619

(22) Filed: Jul. 8, 2005

(65) Prior Publication Data

US 2006/0007284 A1 Jan. 12, 2006

(30) Foreign Application Priority Data

Jul. 9, 2004 (JP) ..... 2004-203181

(51) Int. Cl.
*B41J 2/14* (2006.01)

(52) U.S. Cl. ..... 347/49

(58) Field of Classification Search ..... 347/18, 347/49, 85, 86, 87
See application file for complete search history.

(56) References Cited

U.S. PATENT DOCUMENTS

| | | | | |
|---|---|---|---|---|
| 5,359,357 | A * | 10/1994 | Takagi et al. | 347/49 |
| 5,552,816 | A * | 9/1996 | Oda et al. | 347/86 |
| 5,686,943 | A * | 11/1997 | Kneezel et al. | 347/17 |
| 5,760,806 | A * | 6/1998 | Oda et al. | 347/87 |
| 6,264,297 | B1 * | 7/2001 | Ayata et al. | 347/12 |
| 7,252,375 | B2 * | 8/2007 | Shinada et al. | 347/86 |

FOREIGN PATENT DOCUMENTS

JP A-9-76485 3/1997

* cited by examiner

*Primary Examiner*—Anh T. N. Vo
(74) *Attorney, Agent, or Firm*—Eugene Ledonne; Joseph W. Treloar; Frommer Lawrence & Haug LLP

(57) ABSTRACT

An ink-jet printer including: a head unit for performing recording by ejecting ink onto a recording medium to be fed; an ink cartridge for storing the ink; a heat sink which is in contact with a driver IC that drives the head unit and which cools the driver IC; and a head holder which holds the head unit, the ink cartridge, and the heat sink, wherein the ink cartridge is placed on the heat sink such that the heat sink receives a load from the ink cartridge.

10 Claims, 7 Drawing Sheets

INK-JET PRINTER

The present application is based on Japanese Patent Application No. 2004-203181 filed on Jul. 9, 2004, the contents of which are incorporated herein by reference.

BACKGROUND OF THE INVENTION

1. Field of the Invention

The present invention relates in general to an ink-jet printer, and more particularly to an ink-jet printer including an ink cartridge, a head unit, and a head holder which are carried by a carriage that moves for performing a printing operation, such that the head holder is interposed between the ink cartridge and the head unit.

2. Discussion of Related Art

Conventionally, there is known an ink-jet printer in which an ink cartridge is mounted on a carriage that moves during a printing operation.

The ink-jet printer of the type described above generally includes: a head unit for performing printing or recording by ejecting ink onto a recording medium; a head holder which holds the head unit and which is attached to a carriage that moves in a leftward and rightward direction of the printer, i.e., a direction perpendicular to a feeding direction in which the recording medium is fed; and an ink cartridge removaly mounted on the head holder and accommodating the ink.

The head unit is arranged as follows: the ink is supplied from an ink supply source to an ink inlet of the head unit via an ink supply passage. A plate-type piezoelectric actuator mounted on the head unit selectively applies a predetermined pressure to arbitrary ones of pressure chambers which respectively communicate with a multiplicity of nozzle holes, whereby the ink is ejected from the corresponding nozzle holes. For this end, the head unit includes: a nozzle plate having the nozzle holes through which the ink is ejected for printing; the plate-type piezoelectric actuator which applies the predetermined pressure to the pressure chambers provided in the nozzle plate; and a driver IC which controls a voltage to be applied to the actuator.

On the bottom portion of the ink cartridge where an ink outlet is formed, there is disposed a penetrating member by which the ink cartridge and the head unit are connected to each other. The penetrating member has a flow-passage defining member for defining a flow passage through which the ink is supplied to the head unit, and a joint member functioning as a support via which the ink cartridge is placed on the head holder.

Namely, the ink cartridge is mounted on the upside of the head holder while the head unit is mounted on the downside of the head holder, and the ink cartridge and the head unit communicate with each other through the flow passage defined by the flow-passage defining member so as to penetrate the head holder while the ink cartridge is held by the head holder via the joint member that is disposed on the head holder.

In this respect, an ink-jet printer configured as follows is also known: The ink cartridge is attached to the head holder by pressing the ink cartridge toward the joint member, and a heat sink for cooling the driver IC of the head unit is disposed on the head holder on one side thereof on which the joint member is disposed.

When the printing operation is performed, the ink supplied from the ink cartridge that is mounted on the carriage is fed to the nozzle plate via ink passages formed in the head unit, and the piezoelectric actuator selectively applies the predetermined pressure to the ink, whereby the ink is ejected from the nozzle holes.

The piezoelectric actuator is formed of a piezoelectric ceramic material composed of a ceramic material of lead zirconate titanate (PZT). The piezoelectric actuator includes a plurality of piezoelectric ceramic layers having piezoelectric effect and a plurality of inner electrodes each of which is interposed between adjacent two of the plurality of piezoelectric ceramic layers. Each inner electrode is disposed so as to correspond to a central portion of the corresponding pressure chamber. Portions of the piezoelectric ceramic layers sandwiched by adjacent inner electrodes function as active portions each of which elongates in a stacking direction in which the plurality of piezoelectric ceramic layers are stacked, by applying the voltage to the corresponding inner electrodes.

Upon application of the voltage to the inner electrodes that correspond to arbitrary ones of the plurality of pressure chambers, there is generated, in the active portions, an electric field that is parallel to the polarization direction, whereby the active portions elongate in the stacking direction and the pressure is applied to the ink in the pressure chambers, so that the ink is ejected.

During the printing operation of an image, the temperature of the driver IC which drives the piezoelectric actuator rises. In particular, in a so-called multi-drop type ink-jet printer in which an ink droplet is ejected at a prescribed number for each picture element of the image to be printed and which performs tone production such that each picture element is constituted by the prescribed number of the ink droplet corresponding to image data, the number of times of application of the drive voltage to the head unit in the printing operation of the image significantly increases and therefore the rise in the temperature of the head unit is outstanding.

To deal with the above, there is proposed an ink-jet printing head, as disclosed in JP-A-9-76485 (pages 1-5 and FIG. 3, in particular), for instance, which is equipped with a heat sink for cooling the driver IC of the head unit.

In the ink-jet printer wherein the ink cartridge is removably mounted on the carriage, the head unit needs to be accurately positioned for improving printing accuracy with which the printing by the ink droplet to be ejected onto a sheet of recording paper is performed. Particularly where the carriage carries a plurality of ink cartridges for a color printing operation, there may be caused a risk of color deviation or out of color registration if each head unit is not accurately positioned.

Further, in the carriage which carries the head holder holding both of the ink cartridge and the head unit that has the nozzle plate, the ink cartridge is placed on the head holder such that the ink cartridge is pressed toward the head holder.

SUMMARY OF THE INVENTION

In the carriage on which the ink cartridge is removably mounted, the ink cartridge is attached to the head holder carried by the carriage such that the ink cartridge is pressed by a biasing member, a pressing member, or the like.

Accordingly, where the head holder is formed of a resin or a thin metal plate having a low degree of rigidity, the head holder may suffer from slight deflection or flexure due to a pressing force applied by the pressing member.

In a case where the head holder suffers from deflection, the head unit held by the head holder also suffers from deflection, so that the location of the nozzle plate of the head unit slightly changes from a nominal position on the order of micron. Therefore, where a plurality of ink cartridges are mounted on the head holder, variation in the change of the location of the nozzle plate in each head unit may cause a subtle difference, in each head unit, in the attaching position to which the ink droplet attaches.

It is therefore an object of the invention to provide an ink-jet printer including a head holder carried by a carriage, and an ink cartridge and a head unit which are held by the head holder, the ink-jet printer enabling the head unit to be kept at an accurate or nominal position while preventing deformation of the head holder, in mounting the ink cartridge on the head holder such that the ink cartridge is pressed by a pressing member.

The above-indicated object of the present invention may be achieved according to a principle of the invention, which provides an ink-jet printer comprising: a head unit for performing recording by ejecting ink onto a recording medium to be fed; an ink cartridge for storing the ink; a heat sink which is in contact with a driver IC that drives the head unit and which cools the driver IC; and a head holder which holds the head unit, the ink cartridge, and the heat sink, wherein the ink cartridge is placed on the heat sink such that the heat sink receives a load from the ink cartridge.

In the ink-jet printer constructed according to the present invention, the heat sink which is provided separately or independently from the head holder and which is for cooling the driver IC can be utilized as a member for receiving the load from the ink cartridge, so that the head holder can be prevented from being deformed. Therefore, the head holder can be kept at an accurate or nominal position.

As one preferred arrangement of the present invention, the head holder has a bottom wall portion which faces the recording medium with a predetermined spacing therebetween, and the head unit is mounted on one of opposite surfaces of the bottom wall portion so as to oppose to the recording medium while the ink cartridge is removably mounted on the other of the opposite surfaces so as to sandwich the heat sink therebetween. The ink-jet printer further comprises a pressing member for pressing the ink cartridge toward the heat sink and a connecting member for connecting the ink cartridge and the head unit to each other so as to form a flow passage which penetrates the bottom wall portion, the connecting member including a joint portion which is interposed between the ink cartridge and the heat sink and a flow-passage defining portion which defines the flow passage. Further, the heat sink is arranged to receive, via the joint portion, a pressing force applied to the ink cartridge by the pressing member.

In the above-described one preferred arrangement, the ink of the ink cartridge mounted on the above-indicated other of the opposite surfaces of the bottom wall portion of the head holder can be supplied to the head unit mounted on the above-indicated one of the opposite surfaces, through the flow passage defined by the flow-passage defining portion such that the flow passage penetrates the bottom wall portion. Further, the pressing force applied to the ink cartridge is received by the heat sink via the joint portion, thereby preventing the head holder from being deformed.

BRIEF DESCRIPTION OF THE DRAWINGS

The above and other objects, features, advantages and technical and industrial significance of the present invention will be better understood by reading a following detailed description of preferred embodiments of the invention, when considered in connection with the accompanying drawings, in which:

FIGS. 2A and 2B are views showing ink cartridges mounted on a head holder, in which FIG. 2A is a cross sectional view and FIG. 2B is a view as viewed in a direction indicated by an arrow "A" in FIG. 2A;

FIGS. 4A and 4B are schematic views which respectively simplify FIGS. 3A and 3B, in which FIG. 4A is a schematic view in cross section showing a head holder having a heat sink according to the present invention and FIG. 4B is a schematic view in cross section showing a head holder having a conventional heat sink;

DETAILED DESCRIPTION OF THE PREFERRED EMBODIMENTS

Figure 1:
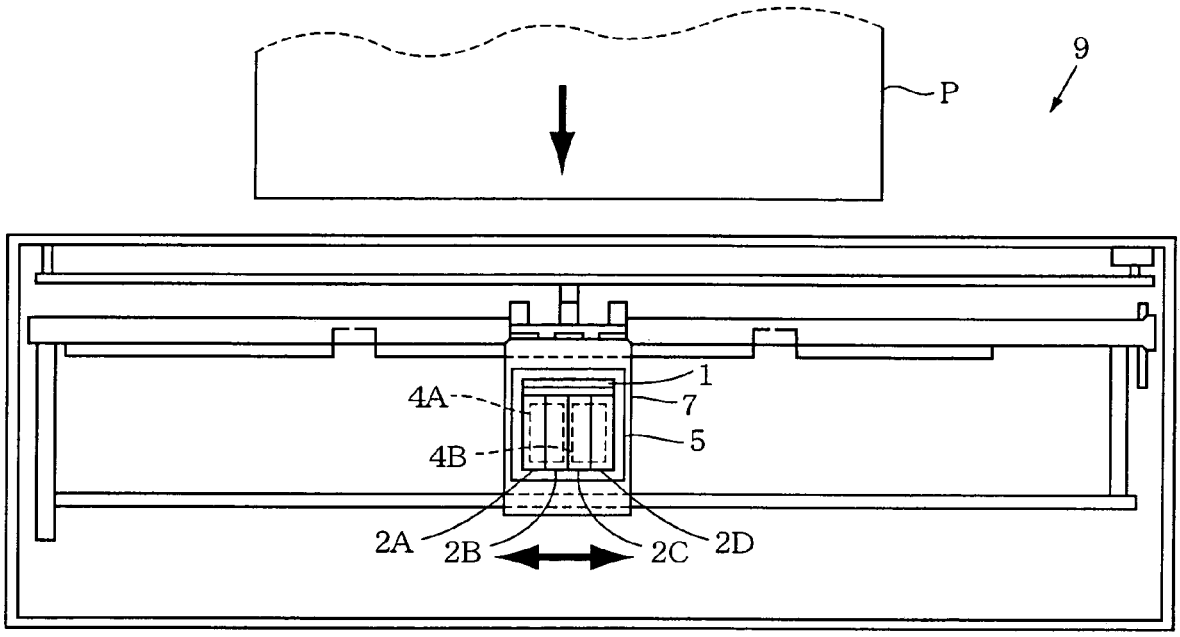
FIG. 1 is a view schematically showing an ink-jet printer according to the present invention.

Referring to the drawings, there will be explained in detail preferred embodiments of the present invention.

Initially, there will be explained a heat sink and an ink-jet printer according to the present invention.

The present ink-jet printer generally indicated at 9 in FIG. 1 comprises a head holder 5 which holds: two head units 4 (4A, 4B) for performing recording by ejecting ink onto a recording medium P to be fed; four ink cartridges 2 (2A-2D) each for temporarily storing the ink; and a heat sink 1 which is in contact with driver ICs 6 that respectively drive the head units 4 and which cools the driver ICs 6. The ink cartridges 2 are placed on the heat sink 1 such that the heat sink 1 receives a load from the ink cartridges 2. (Where it is not necessary to distinguish the two head units 4A, 4B from each other, the head unit may be simply referred to as "the head unit 4". Similarly, where it is not necessary to distinguish the four ink cartridges 2A-2D from one another, the ink cartridge may be simply referred to as "the ink cartridge 2". Further, where it is not necessary to distinguish the two driver ICs 6 from each other, the driver IC may be simply referred to as "the driver IC 6".)

Figure 6:
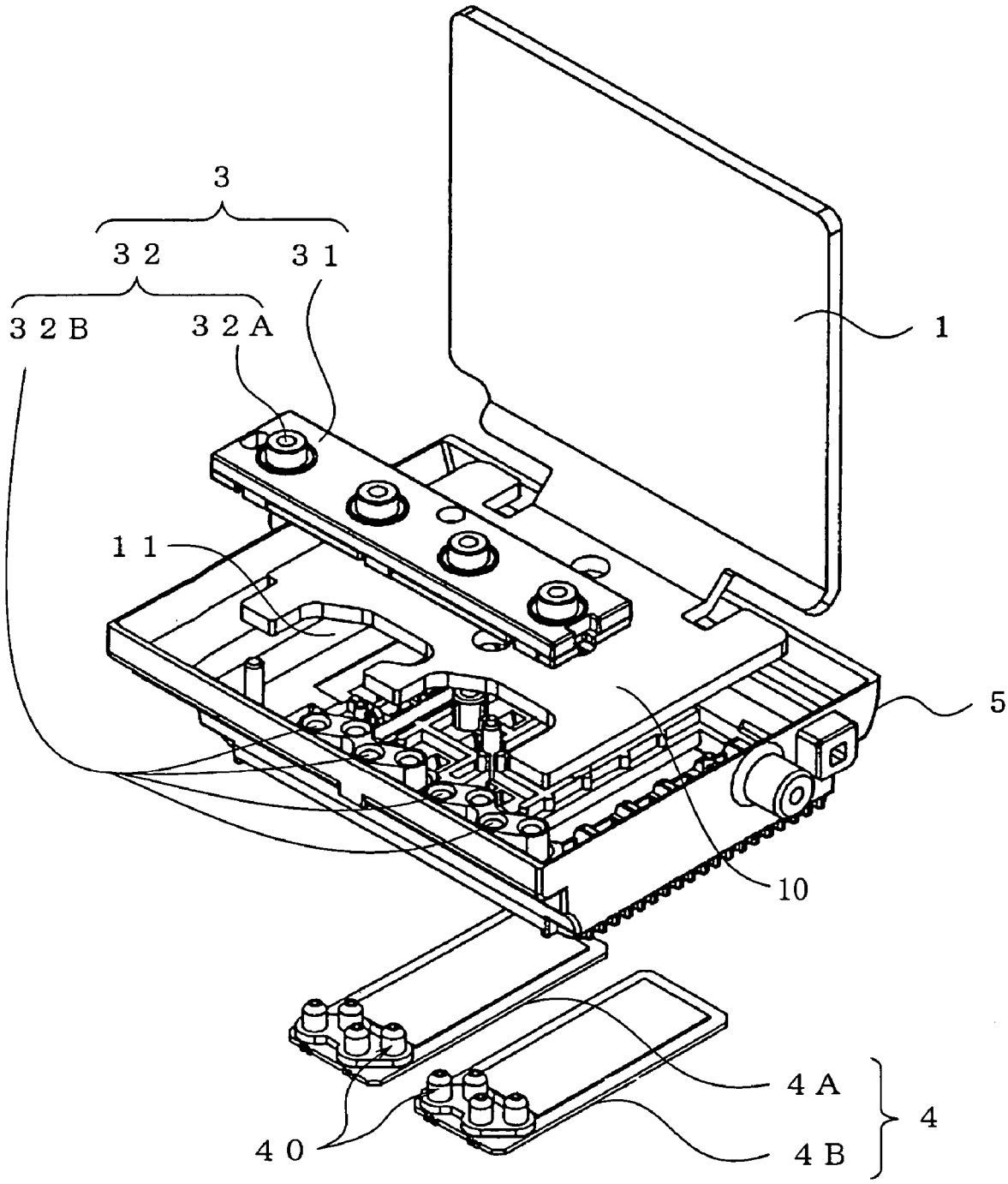
FIG. 6 is an exploded perspective view showing a structure of an ink-jet printing head.
Figure 7:
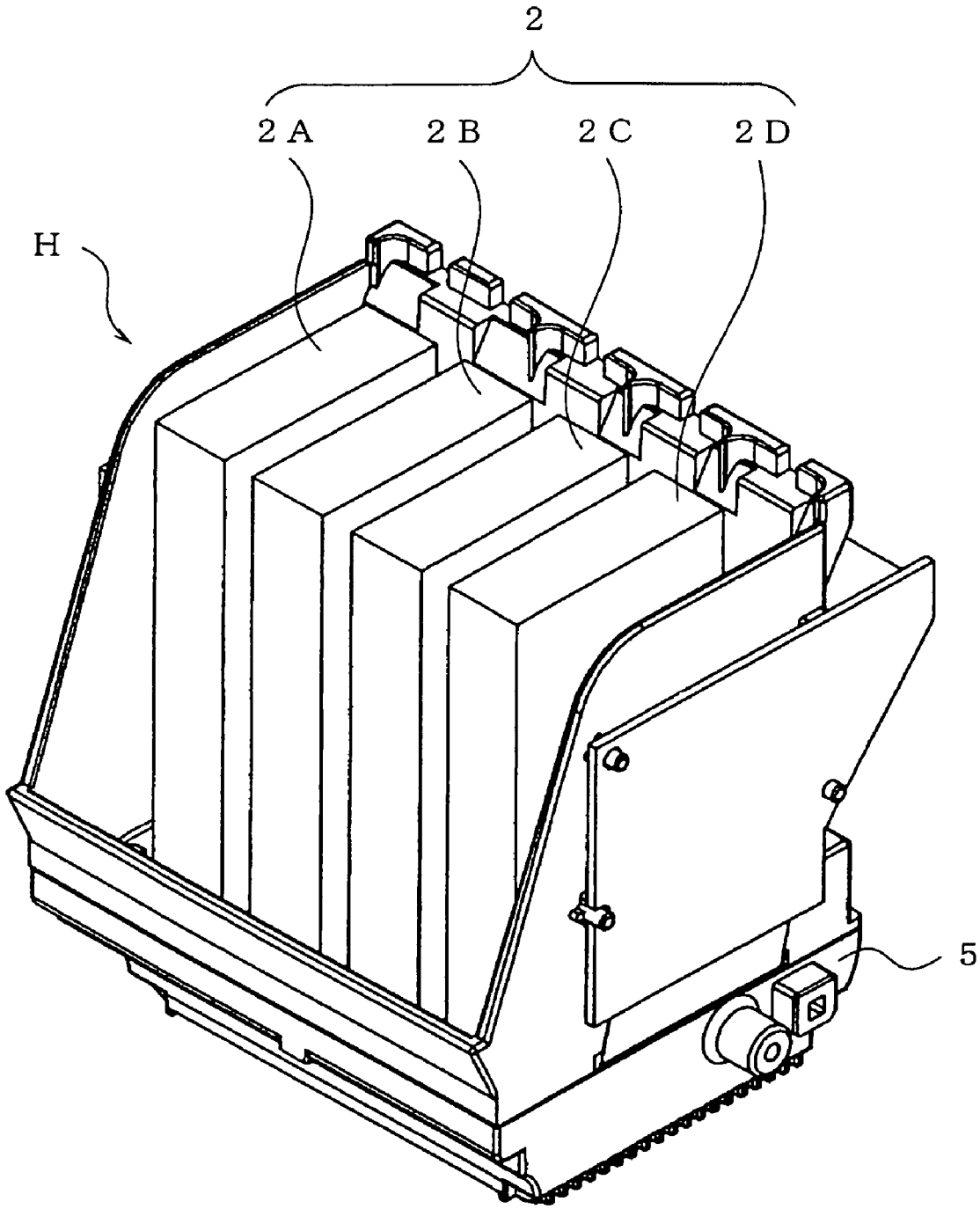
FIG. 7 is a perspective view showing the ink-jet printing head on which the ink cartridges are mounted.

As shown in FIGS. 6 and 7, the heat sink 1 is disposed on the head holder 5 that holds the head unit 4, and the head holder 5 further holds the ink cartridge 2 placed on the heat sink 1, thus integrally constituting an ink-jet printing head H.

In the thus constructed ink-jet printer 9, the load from the ink cartridge 2 does not act directly on the head holder 5, but acts indirectly on the same 5 via the heat sink 1. Accordingly, this arrangement is effective to prevent deformation of the head holder 5, which deformation may adversely influence the printing characteristics of the ink-jet printer 9.

To the lower portions of the respective ink cartridges 2A-2D, there is attached a penetrating member 3 as a connecting member for connecting the ink cartridges 2A-2D to the corresponding head units 4A, 4B. The penetrating member 3 is constituted by a joint member 31 and flow-passage defining members 32 which respectively correspond to the ink cartridges 2A-2D. (Where it is not necessary to distinguish the plurality of flow-passage defining members 32 from each other, the flow-passage defining member may be simply referred to as "the flow-passage defining member 32".) As shown in FIG. 6, each of the flow-passage defining members 32 consists of an upper flow-passage defining member 32A which is formed integrally with the joint member 31 and a lower flow-passage defining member 32B which communicates with the upper flow-passage defining member 32A and which penetrates the head holder 5. Each flow-passage defining member 32 defines a flow passage 33 through which the ink is supplied from each ink cartridge 2 to the corresponding head unit 4. Each flow passage 33 communicates at its upstream portion nearer to the upper flow-passage defining member 32A with the corresponding ink cartridge 2 and at its downstream portion nearer to the lower flow-passage defining member 32B with the corresponding head unit 4. According to this arrangement, the ink stored in the ink cartridge 2 is supplied to the head unit 4 (4A, 4B) via ink-inlet members 40 thereof (which will be described) through the flow passage 33 defined by the flow-passage defining member 32. The penetrating member 3 includes a joint portion interposed between the ink cartridge 2 and the heat sink 1, and a flow-passage defining portion which defines the flow passage 33. In this embodiment, the joint portion is constituted by including the joint member 31 while the flow-passage defining portion is constituted by including one of the flow-passage defining members 32.

As shown in FIGS. 6 and 7, in the present embodiment, one (4A, 4B) head unit has four ink-inlet members 40 two of which are provided for one of the four ink cartridges 2A-2D. Accordingly, the flow-passage defining member 32 for communication between the ink cartridge 2 and the head unit 4 is configured such that the flow passage 33 defined by the flow-passage defining member 32 is branched into two at a connected portion of the same 32 where the upper flow-passage defining member 32A and the lower flow-passage defining member 32B are connected via the joint member 31, although the connected portion is hidden by the joint member 31 and invisible in FIG. 6. Thus, in the present ink-jet printer 9 equipped with the four ink cartridges 2A-2D which respectively store inks of four different colors, i.e., black, yellow, cyan, and magenta, for instance, the two head units 4A, 4B are held by the head holder 5.

The head unit 4 is configured such that a plurality of substrates such as a nozzle plate, a plate-type piezoelectric actuator, etc., are superposed on one another and has a structure similar to that of a known head unit used in an ink-jet printer. More specifically described, the head unit 4 is arranged such that the piezoelectric actuator selectively applies a predetermined pressure to the ink supplied from the ink cartridge 2, thereby ejecting the ink from the corresponding nozzle holes of the nozzle plate.

Figure 5A:
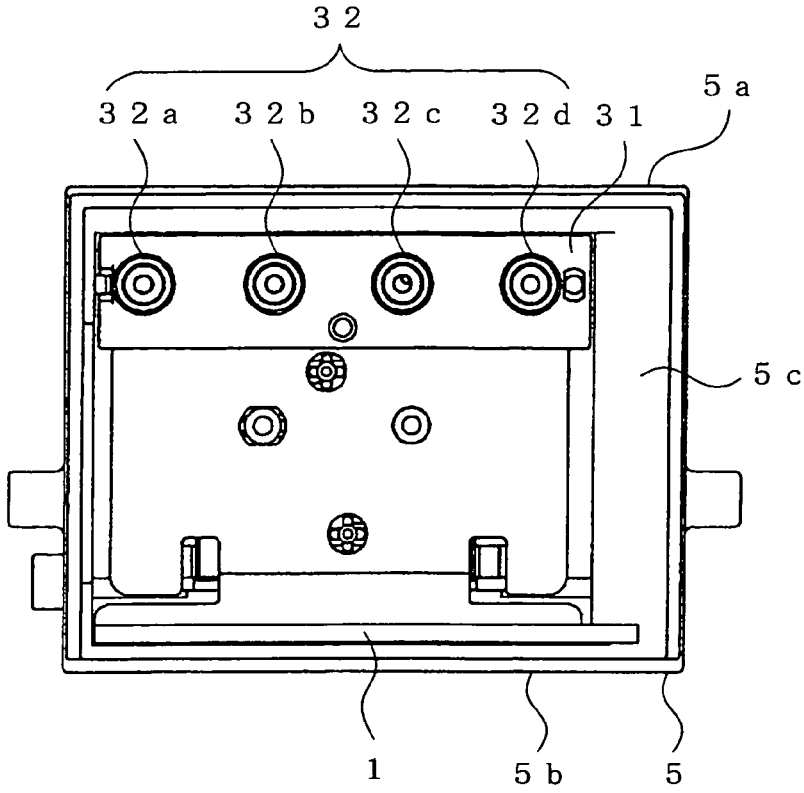
FIG. 5A is a plan view of the head holder to which the heat sink and a head unit are attached and from which the ink cartridges are removed and FIG. 5B is a plan view of the head holder from which a penetrating member is also removed.
Figure 5B:
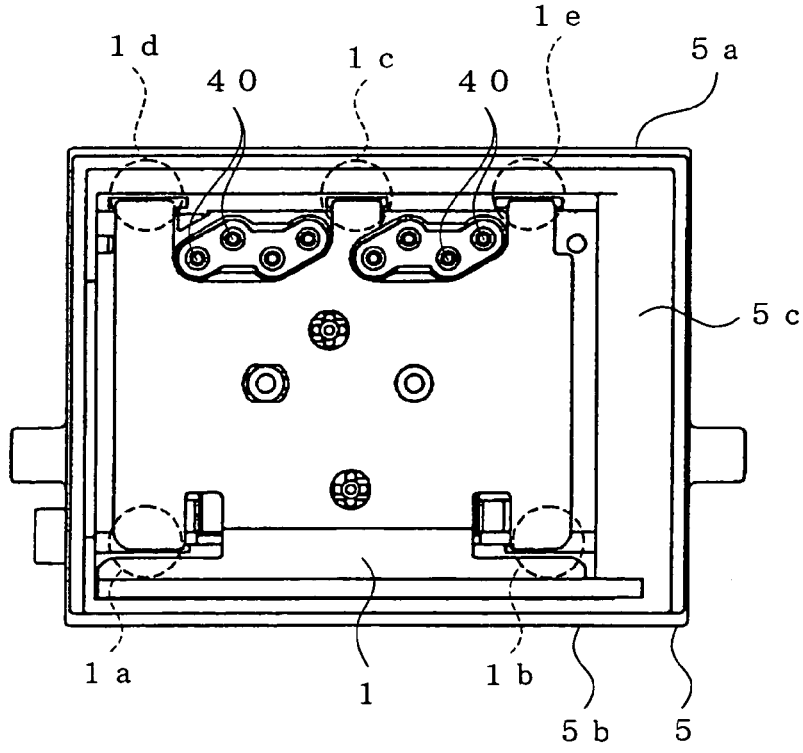

FIG. 5A is a plan view of the head holder 5 to which the head unit 4 and the heat sink 1 are attached and from which the ink cartridge 2 is removed and FIG. 5B is a plan view of the head holder 5 from which the penetrating member 3 is also removed. As shown in FIG. 5A, the four flow-passage defining members 32 (32*a*-32*d*) are provided respectively for the four ink cartridges 2A-2D. Below the flow-passage defining members 32, four ink-inlet members 40 of the head unit 4A and four ink-inlet members 40 of the head unit 4B, in other words, eight ink-inlet members 40 in total are located, as shown in FIG. 5B, such that appropriate four pairs of them are provided for the respective flow-passage defining members 32*a*-32*d*.

The head holder 5 has a generally quadrangular box-like configuration which has a bottom wall portion 5*c* and a pair of mutually opposed side wall portions 5*a*, 5*b* extending upwards from the bottom wall portion 5*c* and which has an upper end opening. The plurality of ink cartridges 2A-2D are removably mounted on the head holder 5 through the upper end opening. The plurality of flow-passage defining members 32 corresponding to the respective ink cartridges 2A-2D are arranged, together with the joint member 31, along and adjacent to one (5*a*) of the pair of side wall portions 5*a*, 5*b* of the head holder 5.

The heat sink 1 is placed on the bottom wall portion 5*c* of the head holder 5. In the present embodiment, the head holder 5 supports, by protrusions thereof (which will be described), the heat sink 1 at three positions 1*a*-1*c* shown in FIG. 5B.

Next, the heat sink 1 according to the present invention will be explained.

Figure 2A:
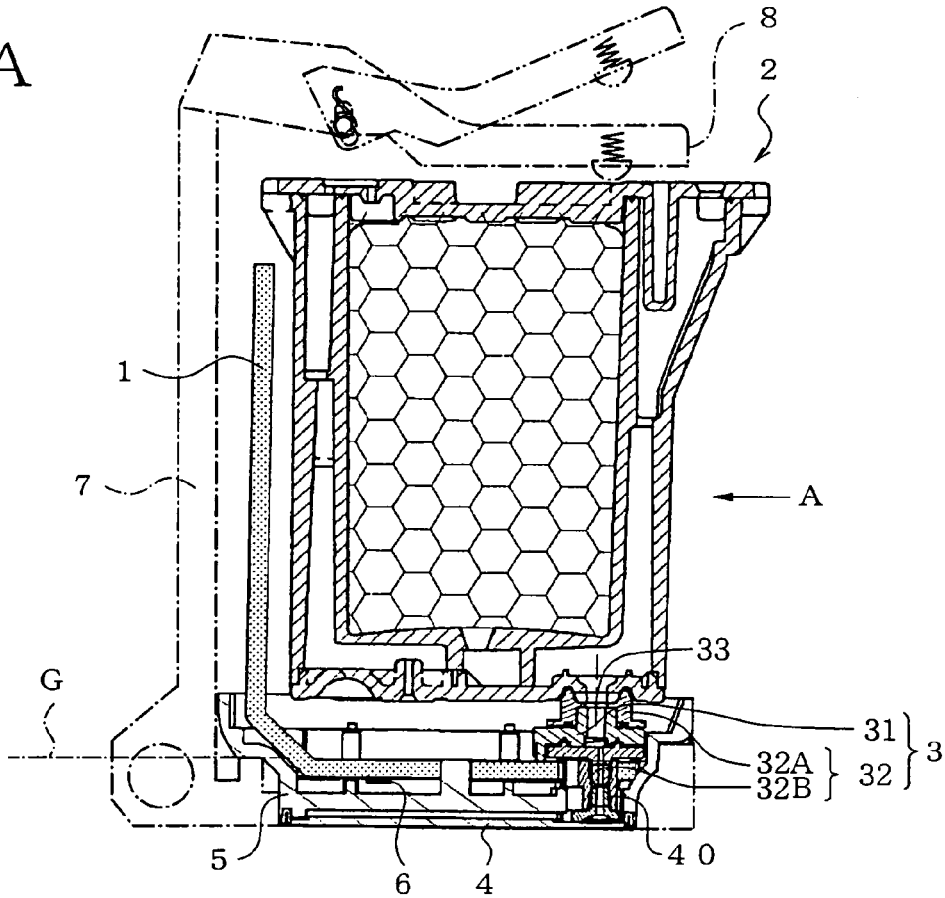

As shown in FIG. 2A, the head unit 4 is arranged such that the ink is supplied from the ink cartridge 2 to an ink inlet of the head unit 4 via the flow-passage defining member 32 (32A, 32B) of the penetrating member 3, and the plate-type piezoelectric actuator unit mounted on the head unit 4 selectively applies a predetermined pressure to the ink in pressure chambers respectively communicating with the multiplicity of nozzle holes, so that the ink is ejected from the corresponding nozzle holes. For this end, the head unit 4 includes the nozzle plate having the multiplicity of nozzle holes through which the ink is ejected for printing, the plate-type piezoelectric actuator for giving the predetermined pressure to the pressure chambers formed in the nozzle plate, and the driver IC 6 for controlling the voltage to be applied to the actuator.

When the piezoelectric actuator of the head unit 4 is driven, the temperature of the driver IC 6 which has control elements for controlling the piezoelectric actuator rises. In particular, in a so-called multi-drop type ink-jet printer in which an ink droplet is ejected at a prescribed number for each picture element of the image to be printed and which performs tone production such that each picture element is constituted by the prescribed number of the ink droplet corresponding to image data, the number of times of application of the drive voltage to the piezoelectric actuator in the printing operation of the image significantly increases and therefore the rise in the temperature of the ink-jet printing head is outstanding.

In the present embodiment, therefore, the heat sink 1 is disposed on the head holder 5 for cooling the driver IC 6 by dissipating the heat generated from the driver IC 6 which is located above the head holder 5 that holds the head unit 4 having the nozzle plate.

Thus, the heat sink 1 is disposed on the head holder 5, and the ink cartridge 2 is mounted on the head holder 5 such that the ink cartridge 2 is placed on the heat sink 1 via the joint member 31 of the penetrating member 3. Namely, the head holder 5 is arranged to hold the ink cartridge 2, the heat sink 1, and the head unit 4.

In the present ink-jet printer 9, there is further provided a carriage 7 that moves in a direction perpendicular to a feeding direction in which the recording medium P is fed. In FIG. 2A, the carriage 7 is indicated by one-dot chain line for distinction from the head holder 5. At an upper end of the carriage 7, there are disposed levers 8 each of which functions as a pressing member for pressing the ink cartridge 2 toward a horizontally extending portion 10 (which will be described) of the heat sink 1 and which are provided for the respective ink cartridges 2A-2D. (Where it is not necessary to distinguish the levers 8 from each other, the lever may be simply referred to as "the lever 8".) The present ink-jet printer 9 is arranged to perform the printing operation such that the ink cartridge 2, the head unit 4, and the carriage 7 move as a unitary or integral unit.

Figure 2B:
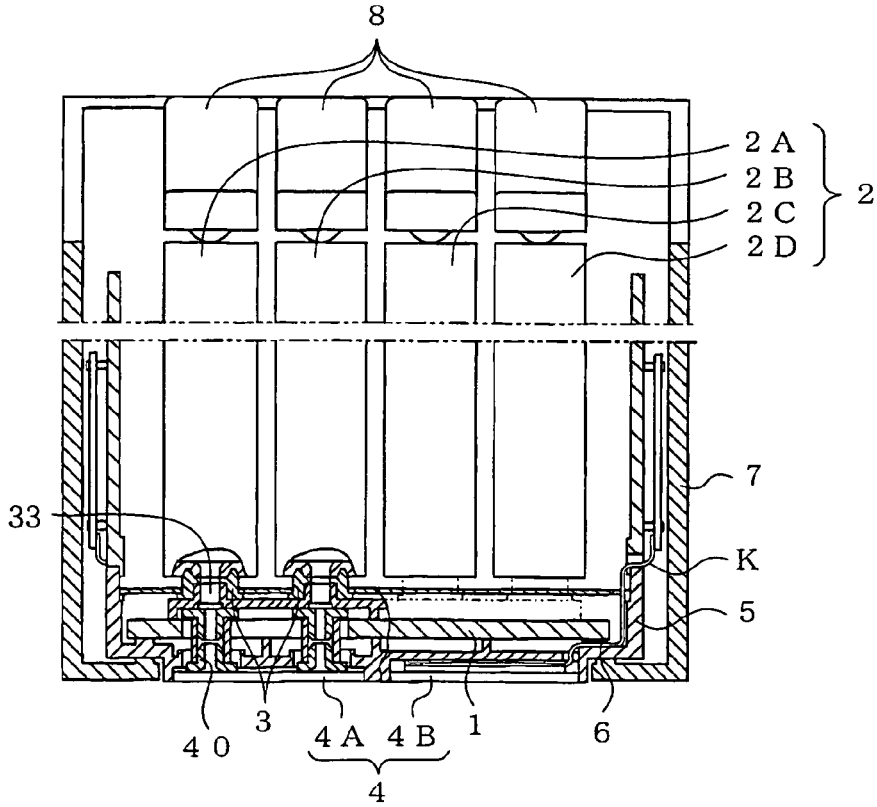

As described above, the penetrating member 3 includes the joint member 31 and the flow-passage defining members 32 each of which is constituted by the upper flow-passage defining member 32A and the lower flow-passage defining member 32B. As shown in FIGS. 2A and 2B, the joint member 31 is sandwiched by and between the ink cartridge 2 and the horizontally extending portion 10 of the heat sink 1 while each flow-passage defining member 32 penetrates the bottom wall portion 5*c* of the head holder 5 for permitting communication between the ink cartridge 2 and the head unit 4.

In this arrangement, a pressing force applied by the leaver 8 to the ink cartridge 2 is received by the heat sink 1 via the joint member 31.

According to this arrangement, the pressing force from the lever 8 is less likely to act directly on the head unit 4, thereby preventing deterioration of the printing quality of the ink-jet printer 9 due to deflection or deformation of the head unit 4. It is needless to mention that a most of the pressing force applies directly to the heat sink 1 via the joint member 31 whereas the head holder 5 indirectly receives the pressing force. Therefore, there is no risk that the head holder 5 deforms due to the pressing force applied to portions thereof which are likely to structurally deform. Further, the ink stored in the ink cartridge 2 is supplied to the head unit 4 having the nozzle plate, via the flow-passage defining member 32 of the penetrating member 3.

In the present arrangement, the head holder 5 is carried by the carriage 7 that moves in the direction perpendicular to the feeding direction, and the pressing force is applied to the ink cartridge 2 by the pressing member 8 provided on the carriage 7. Accordingly, the head holder 5 is prevented from being deformed, so that good printing conditions can be maintained. In addition, the structure of the head holder 5 as a whole can be simplified.

In pressing the ink cartridge 2 by the lever 8, the lever 8 presses the ink cartridge 2 such that the pressing force is applied from substantially right above the joint member 31 toward the heat sink 1. The penetrating member 3 is disposed so as to be spaced apart from the driver IC 6, and the heat sink 1 has the extending portion 10 (FIG. 6) which at least extends from a position where the driver IC 6 is in contact with the heat sink 1 to a position where the penetrating member 3 is located.

Namely, the thus formed extending portion 10 of the heat sink 1 for cooling the driver IC 6 is arranged to support the joint member 31 and receive, via the joint member 31, the pressing force applied to the ink cartridge 2 by the lever 8.

Because the pressing force by the lever 8 is applied to the ink cartridge 2 from substantially right above the joint member 31, a part of the pressing force acts on the penetrating member 3, particularly on the flow-passage defining member 32 to such an extent that deflection or deformation of the head unit 4 is not caused, thereby forming, with high reliability, the flow passage 33 for communication between the ink cartridge 2 and the head unit 4.

As shown in FIG. 2B, in the present embodiment, the four ink cartridges 2A-2D are mounted on the carriage 7, and two 2A, 2B of them are connected to the head unit 4A while another two of them 2C, 2D are connected to the head unit 4B. In other words, the two head units 4A, 4B are held by the head holder 5 so as to correspond to the four ink cartridges 2A-2D.

Accordingly, each head unit 4 is arranged to eject two mutually different colors of inks and has two ink inlets for each of the two mutually different colors of inks. For this end, the flow passage 33 formed for one color of the ink is branched into two as described above.

In other words, for supplying the four different colors of inks stored in the respective ink cartridges 2A-2D to the nozzle plates of the corresponding head units 4A, 4B, the four flow-passage defining members 32*a*-32*d* are connected respectively to the four ink outlets of the respective ink cartridges 2A-2D, and then the two head units 4A, 4B are connected, thereby forming ink paths from the ink cartridges 2 to the nozzle holes of the nozzle plates. Further, in the inside of each head unit 4, there are formed, as a part of the ink paths, a plurality of individual flow passages from the ink inlets of the head unit 4 to the nozzle holes, but a detailed explanation of which is not given here.

In the present ink-jet printer 9, in addition to the driver IC 6 for applying the predetermined voltage to the piezoelectric actuator of each head unit 4, there is further provided a flexible flat cable K (FIG. 2B) for supplying energy to the driver IC 6 and transmitting signals.

As described above, by applying the drive voltage to the piezoelectric actuator formed of the piezoelectric material, the temperature of the driver IC 6 goes up. To deal with this, the heat sink 1 is disposed in contact with the upper portion of the driver IC 6, as shown in FIGS. 2A and 2B, whereby the heat generated from the driver IC 6 is dissipated by the heat sink 1 so as to cool the driver IC 6.

Figure 3A:
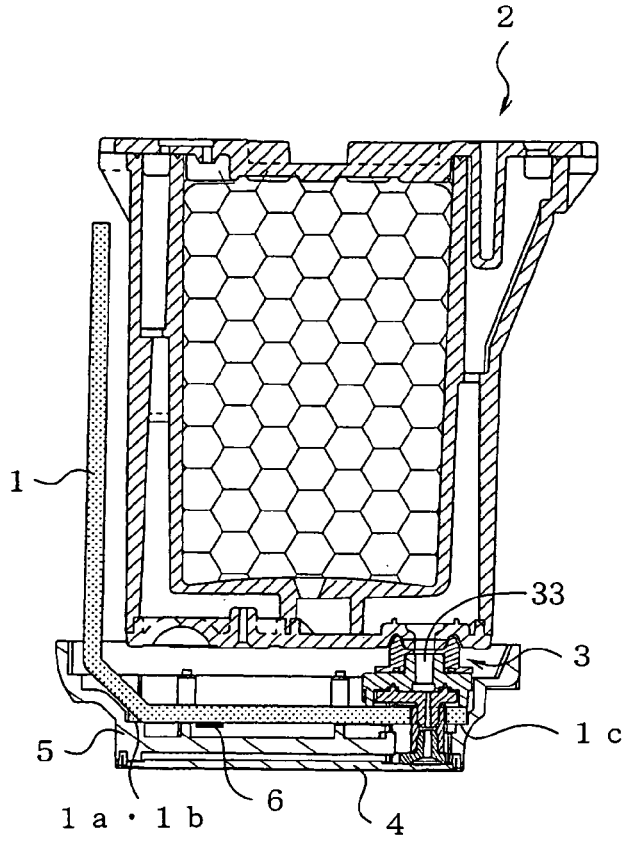
FIG. 3A is a cross sectional view showing a head holder having a heat sink according to the present invention and the ink cartridges and FIG. 3B is a cross sectional view showing a head holder having a conventional heat sink and the ink cartridges.
Figure 3B:
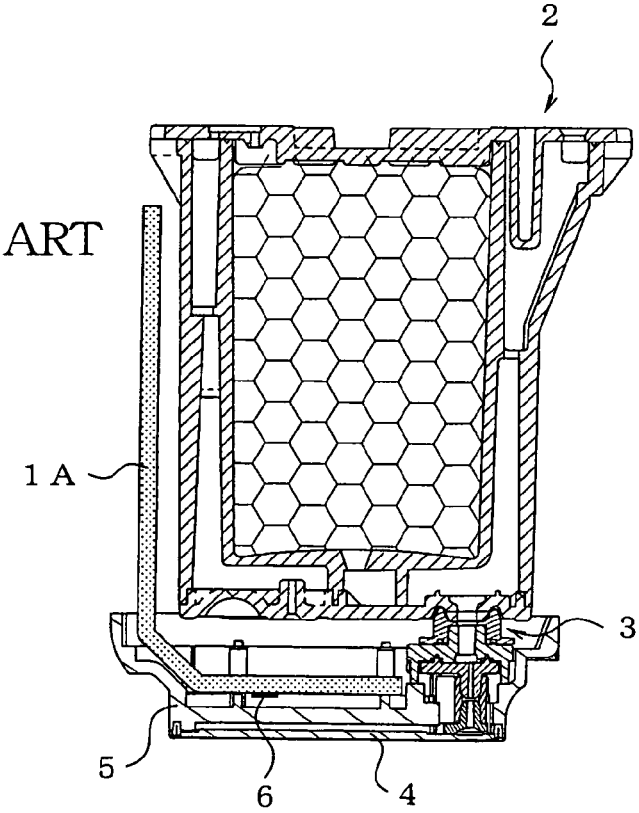
FIG.3B RELATED ART

In the present embodiment, as shown in FIG. 3A, the heat sink 1 is formed such that its bottom portion has the extending portion 10 which extends from the position where the driver IC 6 is in contact with the heat sink 1 to the position where the penetrating member 3 is located, and the heat sink 1 is placed on the head holder 5 while being supported at the three positions 1*a*, 1*b*, 1*c*. In this respect, a conventional heat sink 1A is arranged not to interfere with the penetrating member 3 while being in contact with the driver IC 6, as shown in FIG. 3B. In the conventional arrangement of FIG. 3B, the penetrating member 3 is supported by the head holder 5 at a position of its bottom wall portion near to the peripheral edge (at the right-hand side in FIG. 3B), so that there may be caused a risk that the head holder 5 itself is deformed due to the pressing force to be applied.

The above-described structure according to the present invention will be explained in detail referring to the schematic view of FIG. 4A which simplifies FIG. 3A.

Figure 4A:
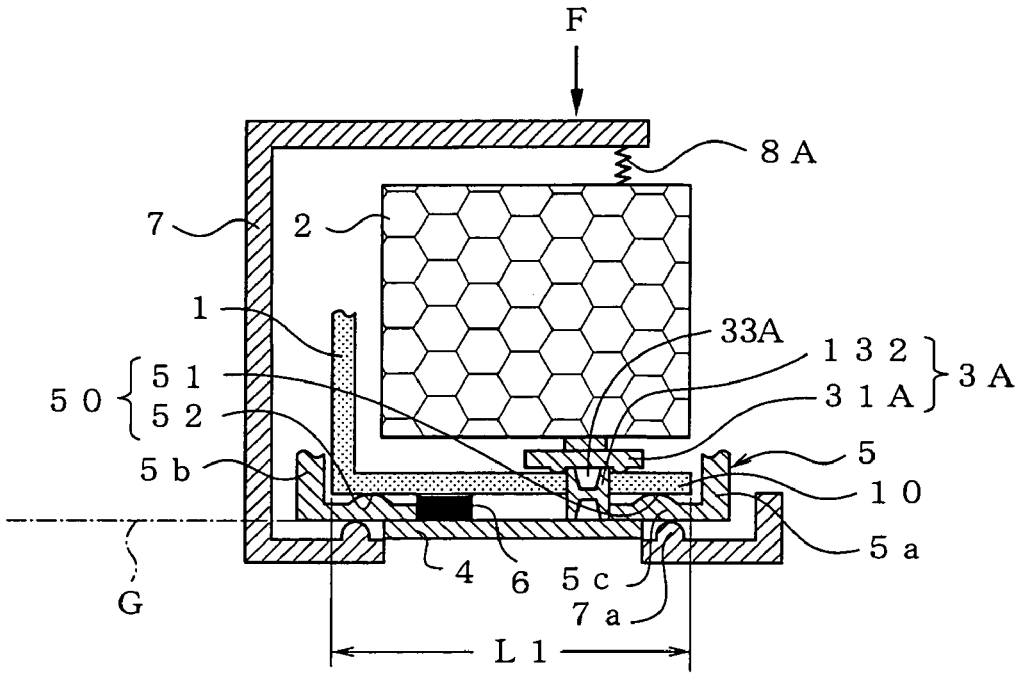
Figure 4B:
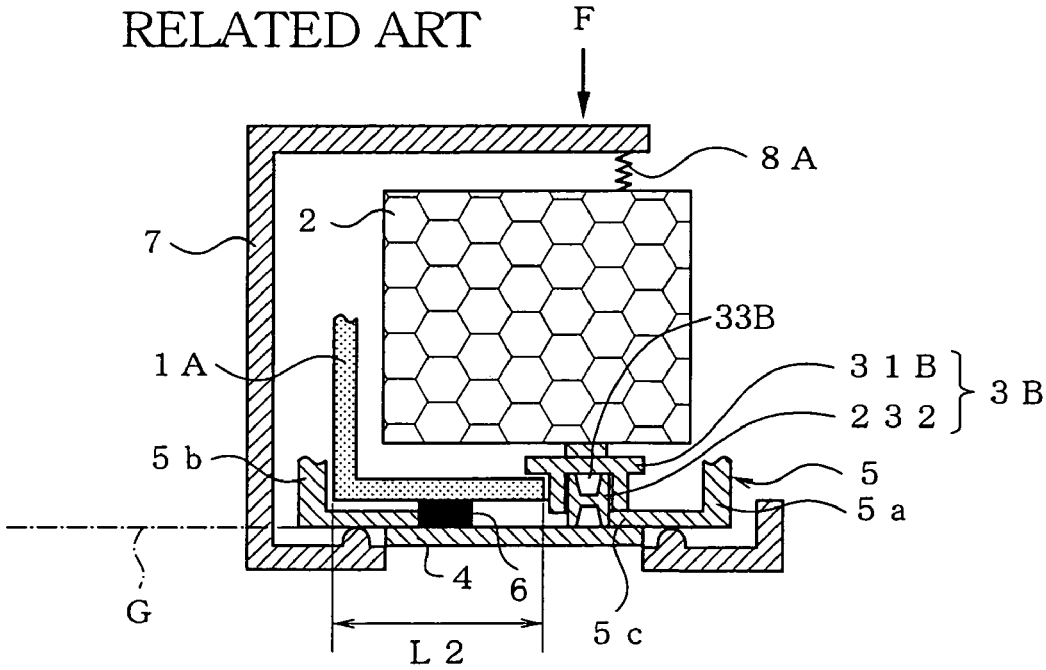
FIG.4B RELATED ART

FIG. 4A is a schematic view in cross section showing a head holder having a heat sink according to the present invention and FIG. 4B is a schematic view in cross section showing a head holder having a conventional heat sink.

As shown in FIG. 4A, a heat sink 1 according to the present invention is a metal plate product having an "L"-shaped cross sectional shape and has a bottom portion a part of which is in contact with driver ICs 6 and a heat-dissipation promoting potion which substantially vertically extends from the bottom portion. The bottom portion of the heat sink 1 has an increased length L1 so as to provide an extending portion 10 which extends from a position where the driver ICs 6 are in contact with the heat sink 1 to a position where a penetrating member 3A is located. As shown in FIG. 4A, the heat sink 1 is placed at its bottom portion on protrusions 50 formed on a bottom wall portion 5*c* of a head holder 5. The protrusions 50 include: a protrusion 51 of a first group which is arranged along one 5*a* of a pair of side wall portions 5*a*, 5*b* of the head holder 5 between flow-passage defining members 132 and the above-indicated one 5*a* of the pair of side wall portions adjacent to which the penetrating member 3A is located; and protrusions 52 of a second group which are arranged adjacent to the other 5*b* of the pair of side wall portions. The protrusions 50 (51, 52) of the first and the second groups are configured to receive a pressing force F applied by each pressing member 8A and function as force-receiving portions.

In the arrangement described above, the protrusions 50 formed on the bottom wall portion 5*c* of the head holder 5 support the extending portion 10 of the heat sink 1 such that the extending portion 10 is located at a predetermined height level. Therefore, the extending portion 10 of the heat sink 1 can be kept at the predetermined height level with respect to a reference height of the head holder 5 (the bottom wall portion 5*c*) which is set in advance, whereby a height level of the ink cartridge 2 to be pressed can be accurately maintained, and the extending portion 10 to which the pressing force is applied can be supported by the plurality of protrusions 50 such that the pressing force is distributed onto the protrusions 50. Accordingly, the head holder 5 is prevented from being deformed and the reference height thereof does not change.

In particular, the protrusion 51 of the first group supports the extending portion 10 of the heat sink 1, whereby the heat sink 1 whose bottom portion has the increased length L can be held by the head holder 5 with high stability.

As shown in FIG. 4A, the penetrating member 3A includes a joint member 31A and flow-passage defining members 132. The extending portion 10 of the heat sink 1 is arranged to support the joint member 31A and receive, via the joint member 31A, the pressing force F applied to the ink cartridge 2 by the pressing member 8A. Namely, the joint member 31A is sandwiched by and between the ink cartridge 2 and the heat sink 1, and the load from the ink cartridge 2 is transmitted to the heat sink 1 via the joint member 31A. In this schematic arrangement, too, the penetrating member 3A functions as the above-indicated connecting member for connecting the ink cartridge 2 and a head unit 4 to each other. Further, the above-indicated joint portion is constituted by including the joint member 31A while the above-indicated flow-passage defining portion is constituted by including one of the flow-passage defining members 132.

In the arrangement as described above, even where the pressing force F is applied to the ink cartridge 2 at a portion thereof which is offset or deviates from a virtual center line of the ink cartridge 2 extending vertically and passing through the center of the ink cartridge 2, toward the right-hand side of the ink cartridge 2 as viewed in FIG. 4A, the pressing force F is transmitted to the extending portion 10 of the heat sink 1 via the joint member 31A and distributed onto the protrusion 51 of the first group and the protrusions 52 of the second group formed on the bottom wall portion 5*c* of the head holder 5. The protrusions 51, 52 are disposed in the vicinity of opposite end portions of the bottom wall portion 5*c* of the head holder 5, respectively, and are arranged adjacent to the respective side wall portions 5*a*, 5*b* of the head holder 5. In other words, the protrusion 51 of the first group and the protrusions 52 of the second group are spaced apart from each other so as to be distant from a virtual center line of the head holder 5 extending vertically and passing through the center of the head holder 5, by the substantially same distance. Accordingly, the pressing force F applied to the ink cartridge 2 so as to deviate from its virtual center line toward the right-hand side thereof as viewed in FIG. 4A is transmitted to the protrusions 51, 52 which support the heat sink 1 from underneath the same 1 at the opposite end portions of the bottom wall portion 5*c* of the head holder 5.

Therefore, the pressing force F can be transmitted, via the heat sink 1, to the head holder 5 so as to be distributed, at a suitable force balance, onto the protrusion 51 and the protrusions 52 that are formed on the respective opposite end portions of the bottom wall portion 5*c* of the head holder 5. Accordingly, even where the head holder 5 receives the pressing force F at a portion thereof which deviates or offsets from the virtual center line thereof, the head holder 5 is less likely to be deformed. In other words, even where the pressing force is applied to the penetrating member 3A that is disposed on one side of the head holder 5, the pressing force can be stably received, via the large or wide surface of the bottom portion of the heat sink 1, by the protrusions 50, because the protrusions 50 for supporting the heat sink 1 are arranged to include the protrusion 51 of the first group arranged along the side wall portion 5*a* of the head holder 5 and the protrusions 52 of the second group arranged along the side wall portion 5*b*.

The flow-passage defining member 132 penetrates the bottom wall portion 5*c* of the head holder 5 for defining a flow passage 33A through which the ink cartridge 2 and the head unit 4 communicate with each other, whereby the ink stored in the ink cartridge 2 is supplied to the head unit 4. The extending portion 10 of the heat sink 1 is formed with cutouts 11 (FIG. 6) through which the flow-passage defining member 132 extends.

The cutouts 11 formed as described above are effective to increase a degree of freedom in assembling the ink-jet printing head itself for the following reasons: The flow-passage defining member 132 is attached to the head holder 5 such that the flow-passage defining member 132 penetrates the bottom wall portion 5*c* of the head holder 5 so as to extend through the cutouts 11. In this respect, the provision of the cutouts 11 permits easy mounting of the heat sink 1 on the head holder 5 at either timing before or after the flow-passage defining member 132 is attached to the head holder 5. Further, owing to the cutouts 11, even where the heat sink 1 has the extending portion 10 which extends to a position at which the heat sink 1 supports the joint member 31A, the flow passage 33A through which the ink in the ink cartridge 2 is supplied to the head unit 4 can be defined by the flow-passage defining member 132.

In the ink-jet printer 9 in which the carriage 7 that moves during the printing operation in the direction perpendicular to the feeding direction of the recording medium P carries the head holder 5 and the ink cartridge 2, a reference position of the head holder 5 with respect to the carriage 7 is determined, and the head holder 5 and the ink cartridge 2 need to be carried such that the head holder 5 is kept at the reference position. Namely, the head unit 4 is mounted on the lower surface (as seen in FIG. 4A) of the bottom wall portion 5*c* of the head holder 5 so as to oppose to the recording medium P. To maintain a predetermined spacing between the bottom wall portion 5*c* of the head holder 5 and the recording medium P, a reference height G of the head holder 5 with respect to the carriage 7 is specified.

For this end, the carriage 7 which supports the bottom wall portion 5*c* of the head holder 5 is provided with a plurality of projections 7*a* (FIG. 4A), and the head holder 5 is placed on the carriage 7 at the plurality of projections 7*a*, whereby the reference height G of the head holder 5 with respect to the carriage 7 is specified.

In the present invention, the protrusions 50 formed on the head holder 5 are disposed at at least three positions in the vicinity of the projections 7*a* of the carriage 7. Accordingly, the head holder 5 can be prevented from being deformed with higher reliability. In this arrangement, the pressing force for pressing the ink cartridge 2 is received by the head holder 5 via the heat sink 1 and also by the carriage 7, and the head holder 5 has the protrusions 50 for supporting the heat sink 1 which are disposed in the vicinity of positions where the carriage 7 supports the head holder 5. Therefore, the height of the head holder 5 can be accurately kept at the specified reference height G.

For instance, the protrusions 50 are disposed so as to correspond to three positions 1*a*, 1*b*, 1*c* of the bottom portion of the heat sink 1, as shown in FIG. 5B. In this arrangement, the protrusions 50 are disposed so as to correspond to: the position 1*c* which is located below the penetrating member 3 and which is adjacent to one 5*a* of the side wall portions 5*a*, 5*b* of the head holder 5 that is adjacent to the ink-inlet members 40 of the head unit 4; and the positions 1*a*, 1*b* adjacent to the other 5*b* of the side wall portions 5*a*, 5*b*.

Accordingly, the protrusions 50 of the head holder 5 are disposed so as to surround at least the flow-passage defining member 32A. Thus, because the protrusions 50 are arranged to receive the heat sink 1 at least three positions (e.g., 1*a*, 1*b*, 1*c*) of the bottom portion of the same 1, the pressing force F is received by the whole bottom portion of the heat sink 1 having a large surface area, such that the above-indicated three positions 1*a*-1*c* of the heat sink 1 receive the pressing force F, even where the pressing force F is applied, in mounting the ink cartridge 2 on the head holder 5, to a location adjacent to one 5*a* of the side wall portions 5*a*, 5*b* of the head holder 5. Therefore, even if the rigidity of the head holder 5 is relatively low, it is possible to avoid deformation of the head holder 5. Accordingly, because the protrusions 50 are disposed so as to surround the flow-passage defining member 132 as described above, the pressing force to be applied to the joint member 31A of the penetrating member 3A is received by the protrusions 50, so that the head holder 5 can hold the heat sink 1 with high stability. For disposing the protrusions 50 so as to surround at least the flow-passage defining member 32A, the central portion of the flow-passage defining member 32A, namely, the center of point of application of the pressing force is located within an area which is bounded by a line connecting the plurality of protrusions 50, for instance.

In the arrangement shown in FIG. 5B, one (51) of the plurality of protrusions 50 is disposed so as to correspond to the position 1*c* located on one side of the heat sink 1 where the cutouts 11 are provided. Depending upon the rigidity and the material of the heat sink 1, there may be a risk that the heat sink 1 itself does not withstand the pressing force F transmitted thereto via the joint member 31A and consequently is deformed, due to the existence of the cutouts 11.

To deal with the risk, the protrusions 50 may be formed so as to correspond to the positions i*d*, le located on the above-indicated one side of the heat sink 1 where the cutouts 11 are provided, in addition to the position 1*c*. In this arrangement, in addition to the protrusion 50 corresponding to the position 1*c*, the four protrusions 50 corresponding to the positions 1*a*, 1*b*, 1*d*, 1*e* which are located at respective four corners of the head holder 5 support the heat sink 1.

Namely, the number of the protrusion 50 of each of the first group and the second group is made plural, whereby the pressing force F can be received by the head holder 5 while being distributed with a suitable force balance even where the heat sink 1 inevitably has a relatively low degree of rigidity for any reason arising from the structure of the heat sink 1 or the material used for forming the same 1.

For compensating for the low rigidity of the heat sink 1 arising from the structure and the material thereof, the protrusions 50 may be further disposed at another position for supporting the heat sink 1. For instance, the protrusion 50 may be formed at the central portion of the bottom wall portion 5*c* of the head holder 5. For distributing the pressing force F onto the head holder 5 with a suitable force balance, the protrusions 50 are preferably disposed so as to surround the joint member 31A of the penetrating member 3A.

In the conventional heat sink 1A shown in FIG. 4B, its bottom portion has a short length L2 which does not reach a penetrating member 3B. Accordingly, the conventional heat sink 1A is only for cooling the driver IC 6 while being in contact with the same 6, and is not contact with a joint member 31B of the penetrating member 3B. Therefore, the conventional heat sink 1 is not arranged to receive the pressing force of the pressing member 8A.

The joint member 31B is sandwiched by and between the ink cartridge 2 and the head holder 5, and the head holder 5 is arranged to receive a load from the ink cartridge 2. Like the flow-passage defining member 132 of FIG. 4A, a flow-passage defining member 232 of FIG. 4B defines a flow passage 33B which penetrates the bottom wall portion 5*c* of the head holder 5 for communication between the ink cartridge 2 and the head unit 4, so that the ink stored in the ink cartridge 2 is supplied to the head unit 4.

Accordingly, in the conventional arrangement of FIG. 4B, when the pressing force F is applied, in mounting the ink cartridge 2 on the head holder 5, to a position adjacent to one 5*a* of the side wall portions 5*a*, 5*b* of the head holder 5, the pressing force F is applied directly to the head holder 5 via the joint member 31B.

Where the head holder 5 is formed of a resin or a thin metal plate whose rigidity is relatively low as described above, the head holder 5 is slightly deformed upon application of the pressing force F thereto. Where the head holder 5 is deformed, the position of the head unit 4 slightly changes from a nominal position, whereby the distance over which the ink droplet to be ejected onto the recording medium P (a sheet of paper) flies subtly changes. In this case, the color deviation may undesirably be caused. Particularly where the color printing operation is performed using the carriage which carries a plurality of ink cartridges, the head holder 5 may be deformed due to the pressing force applied by the pressing members which press the respective ink cartridges and, as a result, the amount of deviation of the head unit from the nominal position differs from one head unit from another, thereby causing a risk of the color deviation.

Conventionally, the heat sink 1 is formed of a metal for exhibiting the heat dissipation property and the rigidity. Accordingly, the heat sink 1 can be configured such that its bottom portion which is in contact with the driver IC 6 is extended for supporting the joint member 31. In view of this, the heat sink 1 of the present embodiment is formed of an aluminum plate having a thickness of 2 mm.

Accordingly, even if the temperature of the driver IC 6 having the control elements for controlling the piezoelectric actuator and the drive voltage applied thereto goes up, the driver IC 6 can be cooled with high efficiency. Further, even where the ink cartridge 2 is arranged to be pressed by the pressing member so as to be mounted on the head holder 5, the pressing force is received by the rigid aluminum plate with the thickness of 2 mm. Therefore, the heat sink 1 can withstand the pressing force, so that the head holder 5 supporting the heat sink 1 can be prevented from being deformed.

As described above, in the present invention, the heat sink 1 which is supported by the head holder 5 and which is in contact with the driver IC 6 for cooling the same 6 is arranged to have the extending portion 11 for supporting the joint member 31 of the penetrating member 3 including the flow-passage defining member 32 that defines the flow passage 33 through which the ink in the ink cartridge 2 which is pressed so as to be mounted on the head holder 5 is supplied to the head unit 4. According to this arrangement, the pressing force by which the ink cartridge 2 is pressed is received by the heat sink 1 formed of the metal, thereby avoiding the deformation of the head holder 5 even where the head holder 5 has a relatively low degree of rigidity.

Where the color printing operation is performed by using the carriage on which the plurality of ink cartridges are carried, each head unit 4 does not deviate from the nominal position even where there is a difference in the pressing force for pressing the respective ink cartridges 2, thus eliminating a risk of causing the color deviation. Therefore, the present ink-jet printer 9 is capable of performing the color printing operation with high accuracy.

It is to be understood that the invention is not limited to the details of the illustrated embodiments, but may be embodied with various changes and modifications, which may occur to those skilled in the art, without departing from the spirit and scope of the invention defined in the attached claims.

What is claimed is:

1. An ink-jet printer comprising:

a head unit for performing recording by ejecting ink onto a recording medium to be fed;

an ink cartridge for storing the ink;

a heat sink which is in contact with a driver IC that drives the head unit and which cools the driver IC; and a head holder which holds the head unit, the ink cartridge, and the heat sink;

wherein the head holder has a bottom wall portion which faces the recording medium with a predetermined spacing therebetween, and the head unit is mounted on one of opposite surfaces of the bottom wall portion so as to oppose to the recording medium while the ink cartridge is removably mounted on the other of the opposite surfaces so as to sandwich the heat sink therebetween, wherein the ink-jet printer further comprises a connecting member for connecting the ink cartridge and the head unit to each other so as to form a flow passage which penetrates the bottom wall portion and the heat sink, the connecting member including a joint portion which is interposed between the ink cartridge and the heat sink and a flow-passage defining portion which defines the flow passage, and wherein the ink cartridge is placed on the heat sink such that the head holder does not directly receive a load from the ink cartridge, but receives the load via the heat sink and the joint portion by placing the heat sink in between and in contact with the head holder and the joint portion.

2. The ink-jet printer according to claim 1, wherein the ink-jet printer further comprises a pressing member for pressing the ink cartridge toward the heat sink, and wherein the heat sink is arranged to receive, via the joint portion, a pressing force applied to the ink cartridge by the pressing member.

3. The ink-jet printer according to claim 2, wherein the pressing member presses the ink cartridge such that the pressing force is applied from above the joint portion toward the heat sink, wherein the connecting member is disposed so as to be spaced apart from the driver IC and the heat sink has an extending portion which at least extends from a position where the driver IC is in contact with the heat sink to a position where the ink cartridge and the head unit are connected by the connecting member, wherein the extending portion is arranged to support the joint portion and receive, via the joint portion, the pressing force applied to the ink cartridge by the pressing member.

4. The ink-jet printer according to claim 3, wherein the extending portion of the heat sink has a cutout through which the flow-passage defining portion extends for defining the flow passage that penetrates the bottom wall portion.

5. The ink-jet printer according to claim 3, wherein the bottom wall portion of the head holder has a plurality of protrusions for supporting the extending portion of the heat sink such that the extending portion is located at a predetermined height level.

6. The ink-jet printer according to claim 5, wherein the plurality of protrusions are disposed so as to surround at least the flow-passage defining portion of the connecting member.

7. The ink-jet printer according to claim 5, wherein the head holder has a box-like configuration having an upper end opening and the ink cartridge is provided in a plural number so that the ink-jet printer comprises a plurality of ink cartridges which are removably mounted on the head holder through the upper end opening, wherein the flow-passage defining portion is provided in a plural number to give a plurality of flow-passage defining portions which respectively correspond to the plurality of ink cartridges, the head holder has a pair of side wall portions which are mutually opposed to each other, and the plurality of flow-passage defining portions are arranged along and adjacent to one of the pair of side wall portions, wherein the plurality of protrusions are classified into a first group to which at least one of the plurality of protrusions belongs and a second group to which at least one of the plurality of protrusions belongs, and the at least one of the plurality of protrusions of the first group is arranged between said one of the pair of side walls and the plurality of flow-passage defining portions while the at least one of the plurality of protrusions of the second group is arranged adjacent to the other of the pair of side walls, and wherein the plurality of protrusions of the first group and the second group are arranged to receive the pressing force.

8. The ink-jet printer according to claim 2, further comprising a carriage which moves in a direction perpendicular to a feeding direction in which the recording medium is fed, the carriage removably carrying the head holder and being provided with the pressing member for applying the pressing force to the ink cartridge that is held by the head holder.

9. The ink-jet printer according to claim 8, wherein the pressing member presses the ink cartridge such that the pressing force is applied from above the joint portion toward the heat sink, wherein the connecting member is disposed so as to be spaced apart from the driver IC and the heat sink has an extending portion which at least extends from a position where the driver IC is in contact with the heat sink to a position where the ink cartridge and the head unit is connected by the connecting member, wherein the extending portion is arranged to support the joint portion and receive, via the joint portion, the pressing force applied to the ink cartridge by the pressing member, wherein the carriage is provided, at an upper portion thereof, with a lever as the pressing member for pressing the ink cartridge from above the joint member toward the extending portion of the heat sink, wherein the carriage is further provided, at a lower portion thereof, with a plurality of projections for specifying a reference height of the head holder with respect to the carriage, and wherein the bottom wall portion of the head holder has at least three protrusions which are disposed in the vicinity of the plurality of projections of the carriage for supporting the extending portion of the heat sink such that the extending portion is located at a predetermined height level, each of the at least three protrusions being arranged to function as a force-receiving portion which receives the pressing force.

10. The ink-jet printer according to claim 1, wherein the heat sink is formed of an aluminum plate having a thickness of 2 mm.

* * * * *